US005218805A

United States Patent [19]

Rex

[11] Patent Number: 5,218,805

[45] Date of Patent: Jun. 15, 1993

[54] POST ASSEMBLY AND NOISE BARRIER WALL

[75] Inventor: Robert G. Rex, Villanova, Pa.

[73] Assignee: Superior Precast, Inc., Pottstown, Pa.

[21] Appl. No.: 747,722

[22] Filed: Aug. 19, 1991

[51] Int. Cl.[5] ..... E04B 2/66

[52] U.S. Cl. ..... 52/295; 256/24

[58] Field of Search ..... 52/295-298, 52/701, 704, 125.5, 263, 250, 722, 723, 368, 260; 256/19, 49, 50, 73, 24

[56] References Cited

U.S. PATENT DOCUMENTS

| | | | |
|---|---|---|---|
| 806,743 | 12/1905 | Hurlburt | 52/368 |
| 913,875 | 3/1909 | Cleverdon et al. | 52/704 |
| 934,423 | 9/1909 | Adams | 256/49 |
| 1,145,462 | 7/1915 | Barton | 52/701 |
| 2,100,614 | 11/1937 | Schenk | 249/19 |
| 2,413,562 | 12/1946 | Henderson | 52/296 |
| 2,420,427 | 5/1947 | Henderson | 52/296 |
| 3,236,019 | 2/1966 | Ballou | 52/125.5 |
| 4,558,850 | 12/1985 | Melfi . | |
| 4,605,090 | 8/1986 | Melfi . | |
| 4,862,992 | 9/1989 | Melfi . | |

FOREIGN PATENT DOCUMENTS

| | | | |
|---|---|---|---|
| 650262 | 9/1928 | France | 52/260 |
| 287167 | of 1965 | Netherlands | 52/295 |
| 43106 | 1/1925 | Norway | 52/295 |
| 592950 | 2/1978 | U.S.S.R. | 256/24 |

*Primary Examiner*—James L. Ridgill, Jr.
*Attorney, Agent, or Firm*—Wall and Roehrig

[57] ABSTRACT

A monolithic reinforced precast concrete post and base assembly is provided for mounting on an in-ground concrete pier having four bolts extending upwardly therefrom to register with four holes in the post and base assembly with the upper ends threaded so that the post and base assembly can be bolted onto and fastened to the in-ground pier. The posts have integral nailing strips for allowing the fastening of sound barrier panels to the posts and the posts are reinforced precast concrete having the necessary strength to withstand the wind-loading and other factors for the particular location of the installation. A sound barrier wall is provided by mounting the post and base assemblies at regular spaced intervals and affixing the sound barrier panels to the posts in either offset or aligned configuration.

6 Claims, 4 Drawing Sheets

POST ASSEMBLY AND NOISE BARRIER WALL

This invention relates generally to post and panel noise barrier walls and more particularly to an improved post assembly for such a wall and a specific post and panel wall construction.

BACKGROUND OF THE INVENTION

Noise barrier walls are becoming more and more common along side super-highways, freeways, airports and other sources of loud noises to reduce the noise level in adjacent residential areas. A well-known type of wall construction is the post and panel type wherein spaced apart posts or columns are formed with grooves to hold intermediate flat concrete panels in place between adjacent posts or columns. Such a construction is disclosed in U.S. Pat. Nos. 4,605,090 and 4,862,992. Other noise barrier walls have been formed from wooden posts and panels in a somewhat similar fashion, and still further examples can be seen in U.S. Pat. No. 4,558,850 which discloses a serpentine series of panels interconnected together to form the noise barrier.

The present invention provides for a concrete post assembly and method of mounting same on an in-ground pier that is particularly adapted for use in noise barrier walls as well as in other types of wall construction. The post assembly of the present invention is constructed so as to be supported in an upright position on an in-ground concrete pier having its upper surface located a short distance below ground level and having embedded therein a plurality of anchor bolts for securing the precast concrete post assembly thereto. Mounting means are cast into the post itself to permit fastening of nailing strips to opposed faces of the vertical post so that wooden panel members can be secured thereto.

OBJECTS AND SUMMARY OF THE INVENTION

Accordingly, it is an object of the present invention to provide a noise barrier wall of the post and panel type which overcomes the limitations of the prior art.

It is another object of the present invention to provide a post and panel noise barrier wall construction having a combination of reinforced concrete post assemblies and wooden panel members fixed to adjacent post assemblies on opposite faces thereof.

It is another object of the present invention to provide a post and panel noise barrier wall that is simple and easy to erect and to maintain and that is more economical to install than prior wall systems.

It is a still further object of the present invention to provide a serpentine post and panel noise barrier wall construction in which the aesthetic and noise absorbing characteristics of a serpentine wall are combined with the efficient and economical post and panel wall type construction.

In an embodiment of the present invention, these and further objects are accomplished by providing a series of precast concrete post and base flange assemblies which are mounted on an in-ground poured concrete pier having anchor bolts extending upwardly therefrom to engage in holes in the flanges of the precast post assembly for mounting of the post assemblies on the piers. Integral fastening means for securing nailing strips to opposed sides of the vertical post portion of the post assemblies are provided and wooden panel planks are secured to the nailing strips on opposite faces of the vertical posts of adjacent post members so as to form a zig-zag appearance. The panel member planks extend beyond each post a suitable distance to provide additional sound deadening capability and to enhance the serpentine effect.

BRIEF DESCRIPTION OF THE DRAWINGS

For a better understanding of these and other objects of the present invention, reference is made to the detailed description of the invention which is to be read in conjunction with the following drawings wherein.

DETAILED DESCRIPTION OF A PREFERRED EMBODIMENT

Figure 1:
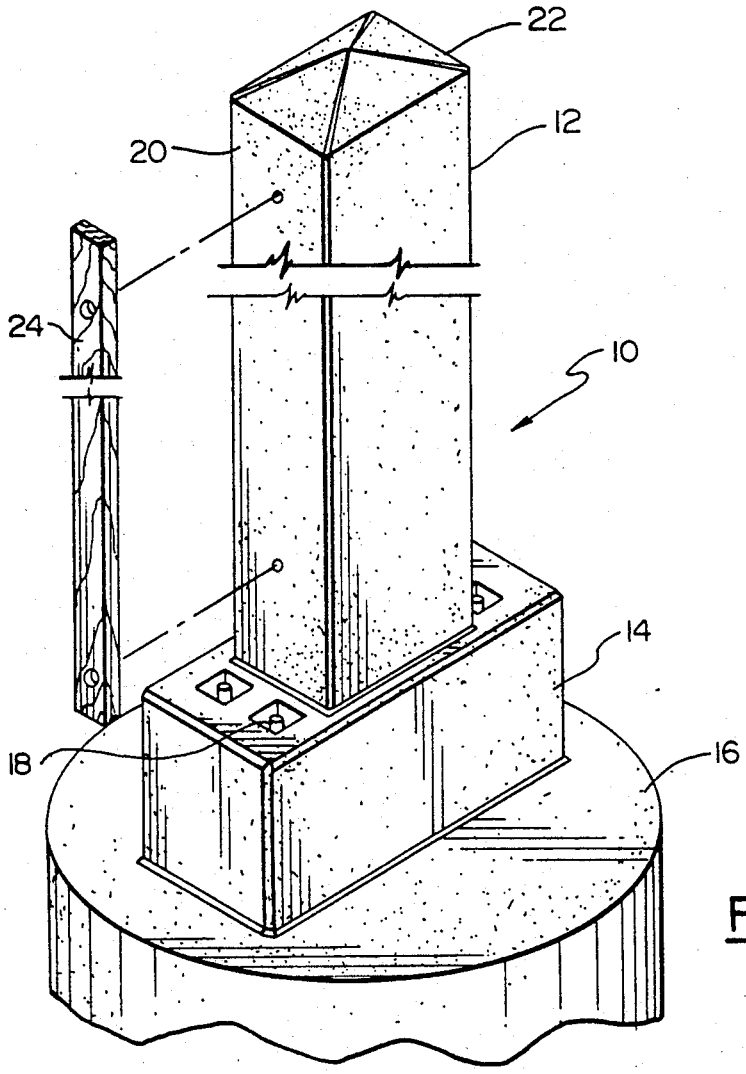
FIG. 1 is a perspective view of a post and flange assembly mounted on an in-ground concrete pier member.
Figure 4:
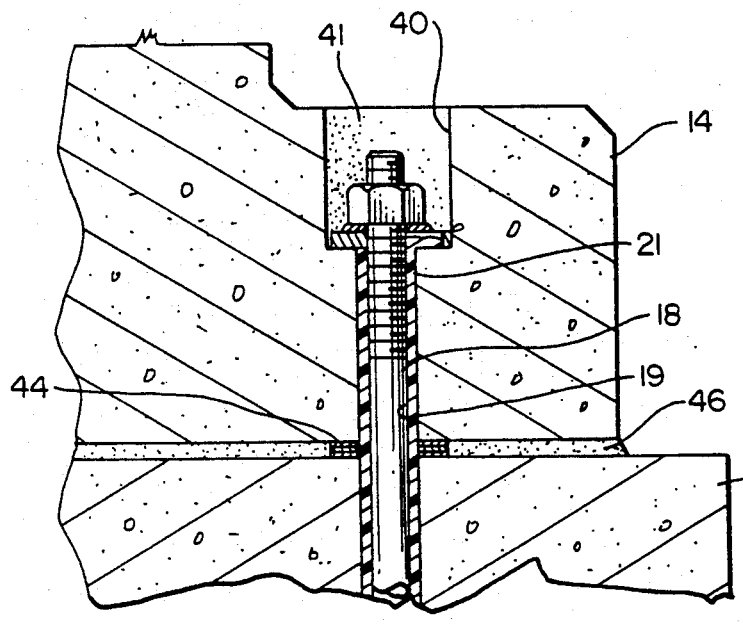
FIG. 4 is a section taken on line 4—4 of FIG. 3.

Referring now to FIG. 1, there is shown a post and flange assembly 10 in accordance with the present invention. As may be seen, the assembly comprises a vertical post or column 12 integrally precast with a base flange 14 which extends outwardly from the post in the direction that the wind loading will be applied to the posts so as to provide a broader base of support. As may be seen, the assemblies 10 are mounted on in-ground concrete anchoring piers 16 by four anchor bolts 18 extending through holes 19 in the flange 14 and recessed into the top of the flange 14 so that the anchor bolts and nuts fastening the assembly 10 to the pier 16 will not extend up above the top surface of the flange 14. The recess may be advantageously filled with grout 41 to form a smooth top surface. This may be seen in detail in FIG. 4.

Figure 7:
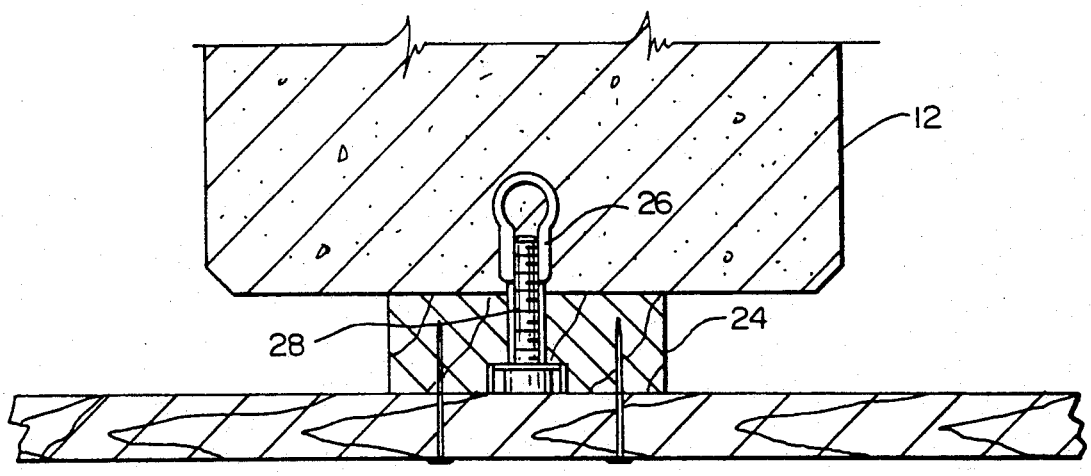
FIG. 7 is a fragmentary cross-sectional view of an anchor for the nailing strip, showing a panel member secured thereto.

Positioned on the faces 20 and 22 of the post 12 are nailing strips 24 which are secured to the respective faces of the post 12 by bolts threaded into embedded anchors 26 as may be seen in FIG. 7. Bolts 28 are threaded into the anchor rings 26 through the nailing strips 24 to secure them to the face of the post 12. The nailing strips 24 are typically 2×6× whatever appropriate length is needed. The loop or ferrule 26 is embedded in the concrete when the post is cast with the end of the threaded portion being positioned flush with the surface of the post. The ferrules 26 are spaced apart the desired distance to securely fasten the nailing strip to the post depending upon the height of the post and the wind loading to be encountered.

Figure 9:
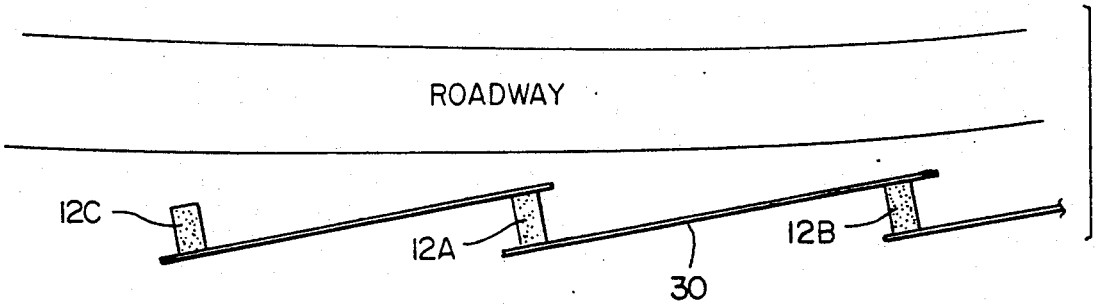
FIG. 9 is a plan view of a segment of a barrier wall constructed with the post and flange assemblies of the present invention.
Figure 8:
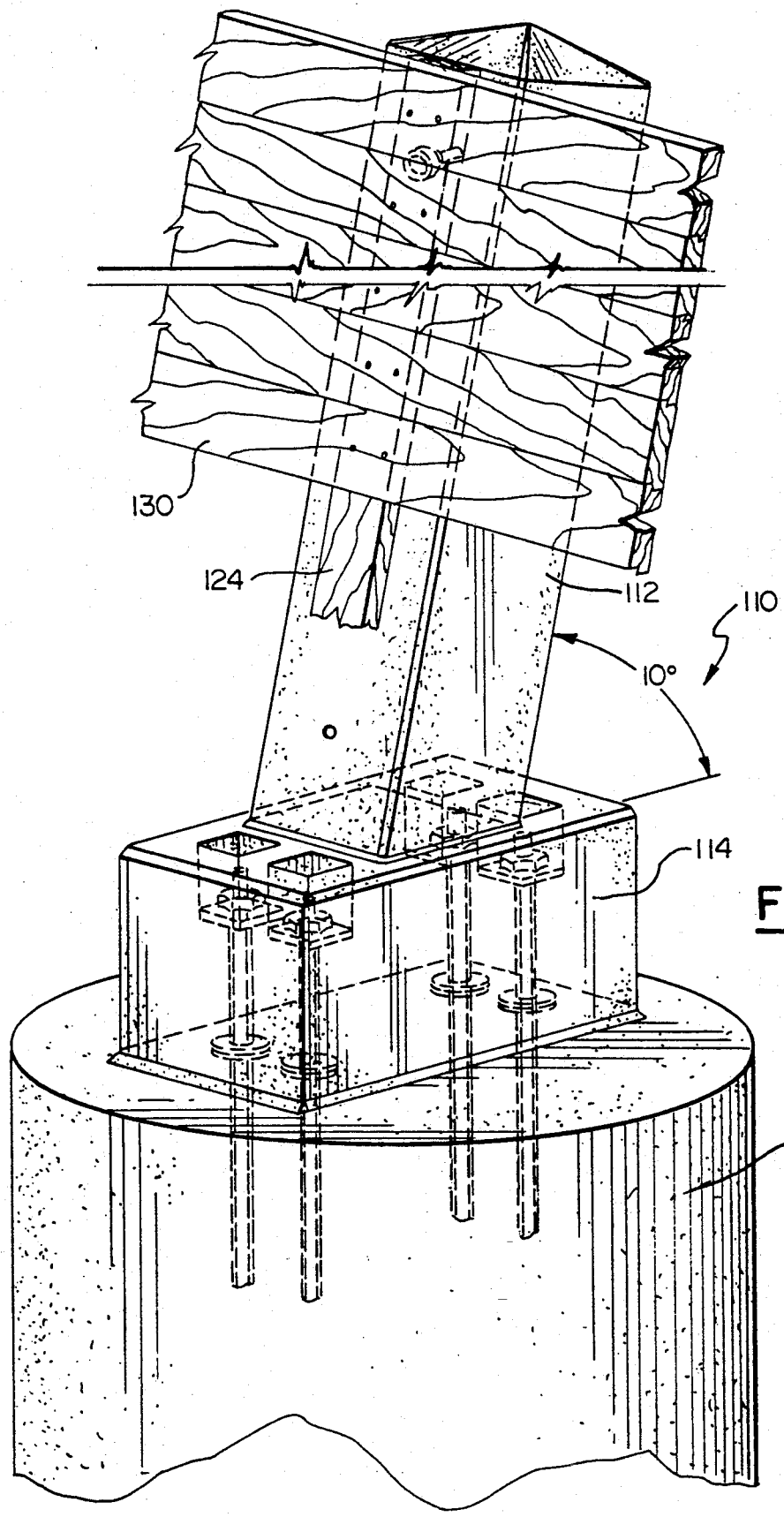
FIG. 8 is a view similar to FIG. 1 of another embodiment of the present invention.

After the nailing strips 24 are secured to the posts planks 30 such as shown in FIG. 8 are secured to the nailing strips to provide the sound barrier as required. The planks 30 are nominally two inches thick and have any suitable width. As seen in FIG. 9, the noise barrier planks 30 are nailed to the inside surface of the left hand post 12 and on the outside face of the right hand post 12 which forms a zig-zag or serpentine noise barrier surface along the length of the wall. The planks 30 may extend approximately one foot beyond the center line of the respective posts to which they are nailed.

Figure 3:
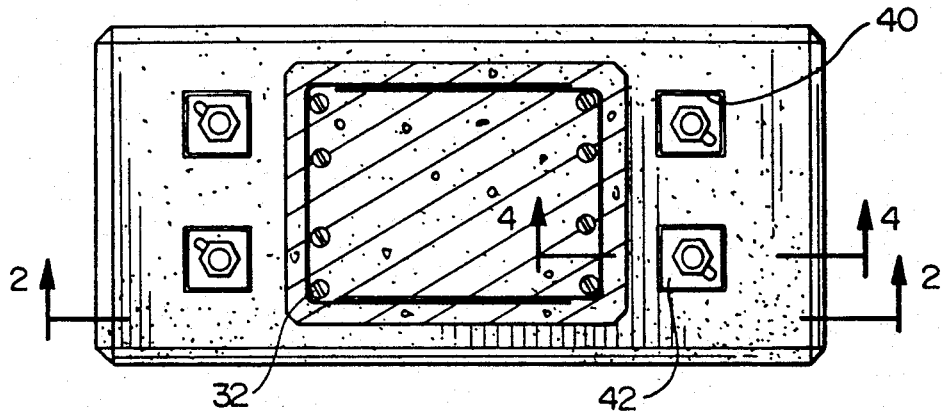
FIG. 3 is a top plan view partially in section taken on line 3—3 of FIG. 2.
Figure 2:
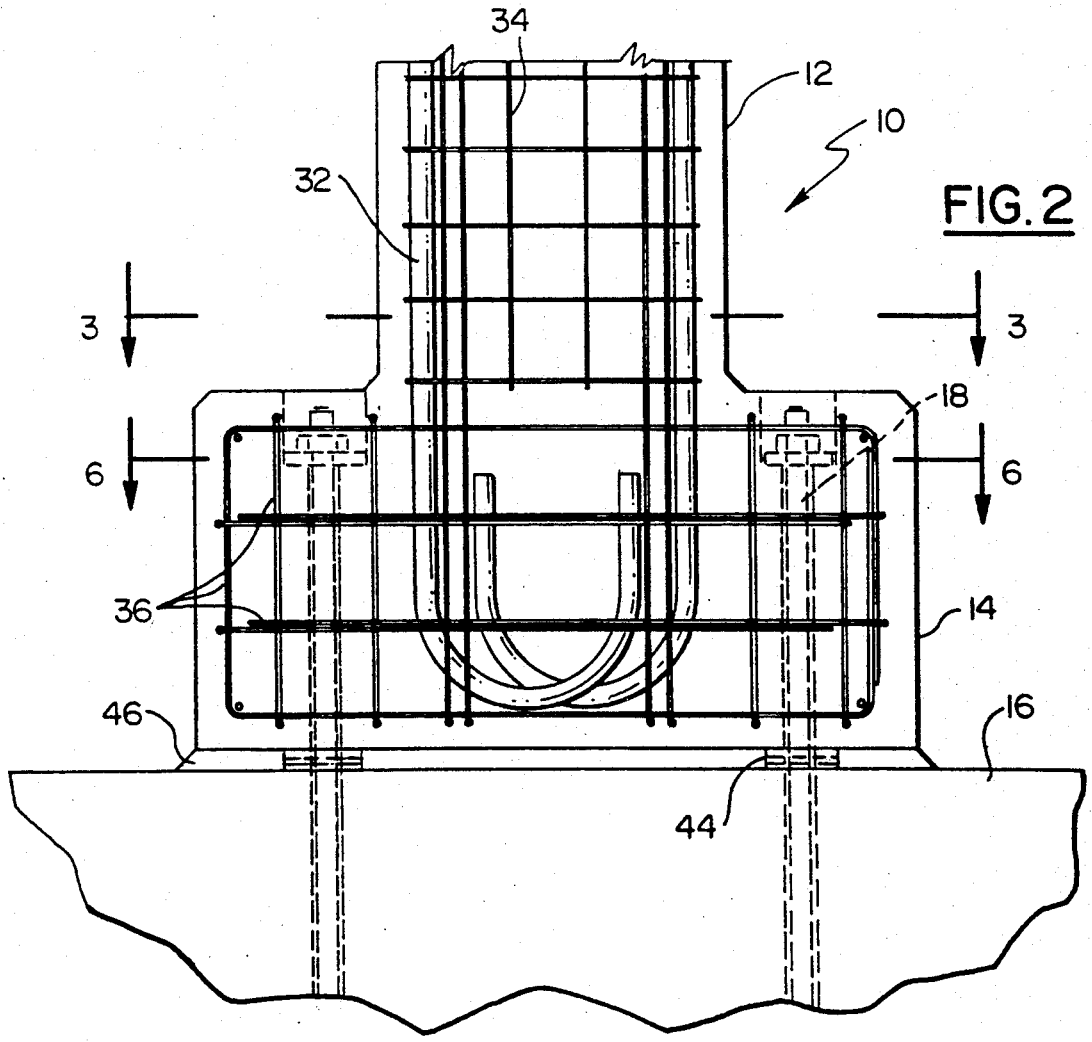
FIG. 2 is a partial section taken through the post assembly of FIG. 1 showing the reinforcing rods and bolt hole positions.
Figure 6:
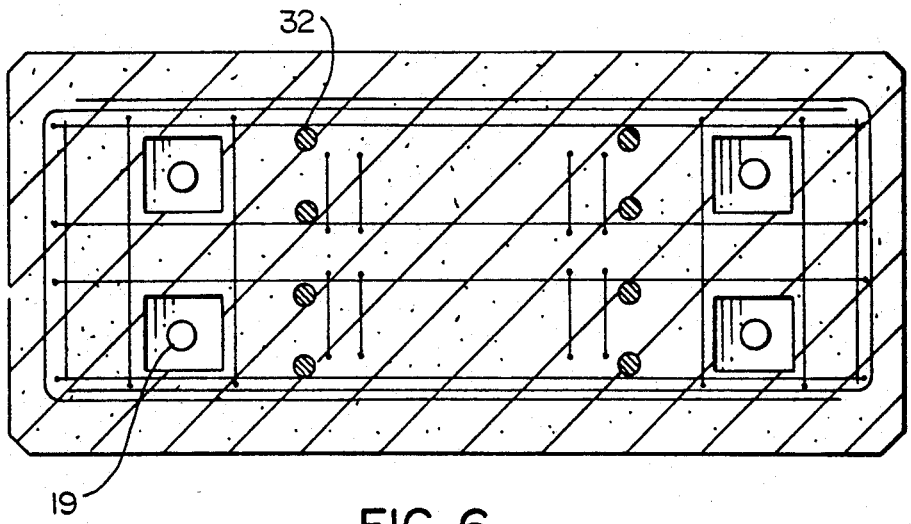
FIG. 6 is a cross-sectional view taken on line 6—6 of FIG. 2.

Referring now to FIG. 2, the post and base flange assembly 10 is shown in cross-section mounted on an in-ground pier 16. In order to form the precast monolithic post and flange assembly with sufficient strength to withstand the wind-loadings normally encountered, a series of reinforcing members or bars must be provided in the lower extremities of the post 12 and particularly throughout the base 14 and the joint or junction between the post and the base. As may be seen in FIGS. 2, 3 and 6, in the particular configuration shown, four heavy rebar hooks 32 are positioned in the lower extremity adjacent the front and back faces of the post 12. Hooks 32 extend down into the base flange 14 with the hook portion being fully embedded within the base flange and extending toward the center. As shown in FIG. 3, four of these are embedded on each face of the post to provide the necessary strengths for wind-loading and so forth. In this configuration typical posts for this application have a width of 14 inches and a depth of from 12 to 18 inches, depending on the height of the wall to be erected. The base flange portion 14 is correspondingly larger and generally will have a width of some 16 to 18 inches and a depth of 22 to 28 inches or so. The particular dimensions are chosen to meet the structural requirements of the particular wall to be erected, based on the height of the wall, the wind loading and other factors well-known in the art. In addition to the large reinforcing hooks 32, reinforcing mesh 34 is provided on each side extending throughout the depth of the lower portion of the post and the base flange has a number of U-shaped hairpins 36 positioned to reinforce and strengthen the base flange to provide the necessary cantilever beam strength for the post when under heavy wind loading. As may be seen in FIGS. 2, 3 and 6, four holes are formed in the base flange portions on both the front and back side of the post and these holes are in registry with corresponding holes in the in-ground pier 16 in which are positioned the anchor bolts 18 which will hold the post securely in place on the in-ground pier 16.

Figure 5:
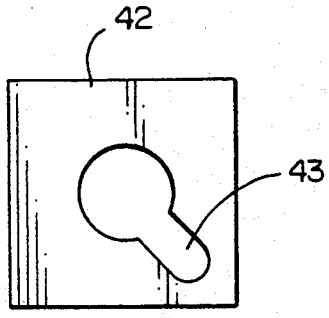
FIG. 5 is a top plan view of a washer used in the securing of the post assembly to the concrete pier member.

As may be seen in FIG. 2, the anchor bolts are somewhat smaller in diameter than the holes 19 in the base 14 and pier 16 and they are secured in place by a bonding resin 21 that is injected around the bolts to securely hold them within the corresponding holes. A suitable resin for this purpose is the Kelbon resin manufactured by Kelken-Gold, Inc. The Kelbon polyester resin securely fills the holes 19 and expands on curing to tightly anchor the bolts 18 in the holes in the pier 16 and also in the holes of the base member 14 of the post assembly 10. Suitable rectangular washers 42 are placed about the top of the bolts in the rectangular recesses 40 of the base with the washers 42 as shown in FIG. 5 having a keyhole slot 43 which allows the introduction of the bonding resin after installation of the nut and washer to hold the bolts in the desired position. This system allows the adjustment of the post and the pier assembly at time of installation to meet the particular requirements of the job location and to compensate for minor discrepancies in dimensions and location of the holes and bolts in the respective parts to be joined together.

Suitable shims 44 are provided about the bolts 18 before the placing of the post and flange assembly 10 over the bolts located in the pier 16, to level the post and base assembly as required at the job site. After the post and base assembly 10 has been installed and secured to the in-ground pier 16, a grout 46 is forced underneath the post assembly 10 below the base portion 14 to completely fill the space therebetween and to form a secure and adequate support for the post assembly 10.

After the monolithic post and base assembly 10 is installed on the in-ground concrete piers, the nailing strips 24 are secured to the front and back surfaces of the posts 12 facing the highway or other area to be shielded by the wall structure. When a wall structure such as shown in FIG. 9 is to be constructed the posts 12 are offset by a small angle from being parallel or perpendicular, as the case may be to the road so as to allow installation of the panel members 30 on the opposite sides of adjacent posts. As shown in FIG. 9, the post **12*a* has the planks 30 mounted on the inside face away from the road and post 12*b* has the planks 30 nailed to the nailing strip on the roadside or outside face of the post 12*b*. Similarly, planks 30*a* are nailed to the outside face of post 12*a* and the inside face of post 12*c*. Obviously, other types of noise barrier wall construction could be utilized with this post and base assembly in which post 12*a* and 12*b*. could have the panels installed on the inside face away from the road and then 12*a* and the next adjacent post to the left 12*c*** on the outside. Other types of wall constructions could also be employed as are well known in the art.

Referring now to FIG. 8, there is shown another embodiment of the present invention in which a "battered" post assembly 110 is provided in which the post 112 is tilted or canted toward the roadway at an angle of approximately ten degrees from the vertical. The assembly 110 is precast as a monolithic structure with the base flange 114 and post 112 forming a single unit which is bolted to the in-ground pier 116 in the same manner as the post assembly 10 of FIG. 1. The reinforcing members for the embodiment of FIG. 8 are sized accordingly to take up the additional load of the battered post in a manner similar to that shown in FIGS. 2, 3 and 6. The ferrule loop fasteners 26 would be embedded in the inside and outside faces of the post 112, just as they are in the posts 12 of FIG. 1. The mounting of the nailing strips 124 and the wooden noise barrier planks 130 would also be the same as for the embodiment of FIG. 1. In certain environments this "battered" or sloped post configuration is found to be advantageous.

I have thus shown a noise barrier wall construction having a post and flange monolithically precast together to form a post assembly that can be economically manufactured and simply and easily installed on site to form the vertical posts or columns for the noise barrier wall. While I have shown the post and base assemblies 10 mounted on in-ground piers having a circular configuration, it is obvious that rectangular or square piers of suitable size could be used where desired.

While this invention has been explained with reference to the structure disclosed herein, it is not confined to the details set forth and this application is intended to cover any modifications and changes as may come within the scope of the following claims.

What is claimed is:

1. A post and panel noise barrier for resisting high wind loading that includes a plurality of upright, pre-cast post assemblies mounted on spaced apart, in-ground piers, each post assembly containing an elongated, vertically-disposed, rectangular post having opposed side walls and front and back walls, and a rectangular base flange that is integral with said post, said base flange having a width substantially equal to the width of the post between the opposed side walls and a depth greater than the depth of the post between the front and back walls, the base flange having extended sections that protrude outwardly from the front and back walls of each post, a plurality of reinforced rod cast into each post assembly, each rod extending from a distal end situated in the base flange upwardly into said post, the distal end of each rod being turned into a U-shaped bend with both legs of the bend lying in a plane that is normal to the front and back walls of each post, nailing strips secured to the front and back walls of each post and blank members extending between adjacent posts that are attached to said nailing strips to form a vertical panel between said adjacent posts whereby wind induced forces acting upon said panels are transmitted to the post assemblies so that the resultant force acting against each post is in a plane generally normal to said front and back walls.

2. The post and panel noise barrier of claim 1 that further includes bolting means mounted in the extended sections of each base flange for attaching each assembly to a pier and further supporting the post assemblies against the resultant wind loading forces along upon the assemblies normal to the front and back walls of the posts.

3. The post and panel noise barrier of claim 1 that further includes threaded insert means cast into each post, and bolt means receivable in said insert means for securing said nailing strips to said posts.

4. The post and panel noise barrier of claim 1 that includes wire mesh means cast into each post assembly for further reinforcing each post assembly.

5. The post and panel noise barrier of claim 1 wherein each post forms an arcuate angle with the base flange within a plane normal to the front and back walls of said post.

6. The post and panel noise barrier of claim 1 wherein the planks are nailed at one end to the front wall of a first post and at the opposite end to the back wall of a second adjacent post.

* * * * *